US005630624A

United States Patent [19]

Goodman

[11] Patent Number: 5,630,624

[45] Date of Patent: May 20, 1997

[54] IN-LINE SKATE FRAME PROTECTOR

[76] Inventor: Scott A. Goodman, 311 Montana Ave., Apt. 205, Santa Monica, Calif. 90403

[21] Appl. No.: 155,281

[22] Filed: Nov. 22, 1993

[51] Int. Cl.[6] ..... A63C 17/00

[52] U.S. Cl. ..... 280/809; 280/11.22

[58] Field of Search ..... 280/809, 811, 280/841, 843, 11.19, 11.22, 11.2

[56] References Cited

U.S. PATENT DOCUMENTS

| | | | |
|---|---|---|---|
| 931,064 | 8/1909 | Hollar | 280/11.19 |
| 2,168,820 | 8/1939 | Edstrom | 280/11.19 |
| 3,086,787 | 4/1963 | Wyche | 280/11.19 |
| 4,070,029 | 1/1978 | Panarelli | 280/11.19 |
| 4,214,768 | 7/1980 | Dominy et al. | 280/809 |
| 4,273,345 | 6/1981 | Ben-Dor et al. | 280/11.2 |
| 4,323,259 | 4/1982 | Boudreau | 280/11.23 X |
| 5,234,230 | 8/1993 | Crane et al. | 280/811 |
| 5,236,224 | 8/1993 | Anderson et al. | 280/825 |
| 5,239,941 | 8/1993 | Chibi | 280/11.2 |

OTHER PUBLICATIONS

Rollerblade™ 94 Catalog (1993) pp. 14 & 15.

Box Magazine Fall 1993 p. 35.

Daily Bread Magazine Nov. 1993 issue #2 pp. 2, 11, 13, 25, 30.

Dare to Air (1993) VHS Video (see video sequence indicated by black lines drawn on face of tape).

Inline Magazine Sep. 1993 p. 19.

*Primary Examiner*—Brian L. Johnson
*Assistant Examiner*—Frank Vanaman
*Attorney, Agent, or Firm*—Daniel M. Chambers

[57] ABSTRACT

Various means designed to protect an in-line skate frame from direct impact with damaging and/or abrasive surfaces are disclosed. Such protective means mount to the skate frame and may be manufactured from various materials, including metals, plastics, composites, and ceramics. Also disclosed are methods of preventing direct impacts to or abrasions of a skate frame using the disclosed protective means.

6 Claims, 5 Drawing Sheets

IN-LINE SKATE FRAME PROTECTOR

FIELD OF THE INVENTION

The present invention relates to in-line skating. Specifically, this invention concerns a means of protecting the frames of in-line skates and a method of preventing wear to such frames induced by contact with abrasive surfaces.

BACKGROUND OF THE INVENTION

In-line skating is a form of recreation practiced for more than two hundred years in various areas of the world. In recent times, it has evolved into a multi-faceted activity. Included among such activities is speed skating, hockey, cross-training, off-season training for ski and ice-skating, dance, free-style, and so-called "street style" skating. Street style skating comprises a number of stunts, including, but not limited to, curb and handrail "grinding," stair riding, ramp skating, jumping, and "stalling" (coming to an abrupt stop). Many of these activities significantly and rapidly degrade the quality of the in-line skating equipment.

Typically, an in line skate consists of three basic components: a boot; a frame; and wheels. An in-line skating boot generally comprises one or more parts which serve to secure a foot of the skater to the remaining components of the skate. The boot is attached to the frame, which itself holds the wheels. As inferred by the term "in-line" skate, the wheels are aligned single file in the direction of skate travel. See FIG. 1. Each wheel in the system is usually attached to the frame via an axle bolt. As a result of this alignment, portions of the frame, especially those portions between the wheels, are potentially exposed to impacts with various surfaces. In street style skating, the potential for such impacts is markedly increased, and when it occurs repeatedly, and/or when it occurs against an abrasive surface, the skate frame may be damaged.

As a result of these hazards, different approaches have been taken to prevent damaging impacts or abrasive surface contacts with the skate frame. Such approaches involve the mounting of one or more skate wrenches to the outer side of either or both sides of the frame using existing frame hardware, specifically the axle bolts. See FIG. 4. However, such systems fail to adequately protect the lower regions of the skate frame from direct contact or abrasion, as these surfaces are left exposed and unprotected.

It is the object of this invention to provide an improved means to prevent such impact or abrasive damage from occurring with or to the skate frame. To accomplish this, an in-line skate frame protective means has been developed. When affixed to the frame, the potential for such damaging contacts are substantially reduced, thus increasing the useful life of what can be very expensive equipment.

SUMMARY OF THE INVENTION

The present invention concerns novel means of protecting in-line skate frames from direct and/or abrasive contacts or impacts. One aspect of the invention relates to the protective means themselves, one embodiment of which is depicted in FIG. 2. In another embodiment, the protective means of the invention comprise two vertical members, each of which serves to shield all or a portion of the skate frame to which they are attached. In a preferred embodiment, the two vertical members are attached by a connecting means. Another embodiment concerns the materials comprising the protective means. Particularly preferred materials include: metals, plastics, composites, and ceramics.

Another aspect of the invention involves a protective means according to the invention affixed to an in-line skate frame.

Yet another aspect of the invention concerns the use of protective means according to the invention to prevent direct impacts to or abrasion of an in-line skate frame. This is accomplished by affixing the protective means described herein to an in-line skate frame in a manner so as to prevent direct impacts and abrasion.

BRIEF DESCRIPTION OF THE FIGURES

FIG. 6 shows a top view of the template sketched on the angle iron, while

Numerous advantages and aspects of the invention will be apparent to those skilled in the art upon consideration of the following detailed description which provides illustrations of the invention in its presently preferred embodiments.

DETAILED DESCRIPTION OF THE INVENTION

The present invention relates to in-line skate frame protective means [also referred to herein as "skate frame protector(s)" or "protector(s)"] and methods for using such means to prevent damaging impacts to and/or abrasive contacts with a skate frame. As used in this invention, a skate frame protective means is any means that prevents direct impact to or contact with an underside portion of a skate frame. The underside of a skate frame (see FIG. 1) is that side, edge, or surface of the frame closest to (and most cases, parallel to) the ground and is opposite that side, edge, or surface (the "upper" side) of the frame that contacts the sole, bottom, or lower surface of the boot. An underside portion of a skate frame is understood to range from the entire underside of the skate frame (exclusive of those areas required for wheel protrusion, etc.), the entire underside of either of an inboard side or an outboard side of a skate frame, to as little as 0.01 in. (inch) of either of the undersides of an inboard or outboard side of a frame.

Figure 1:
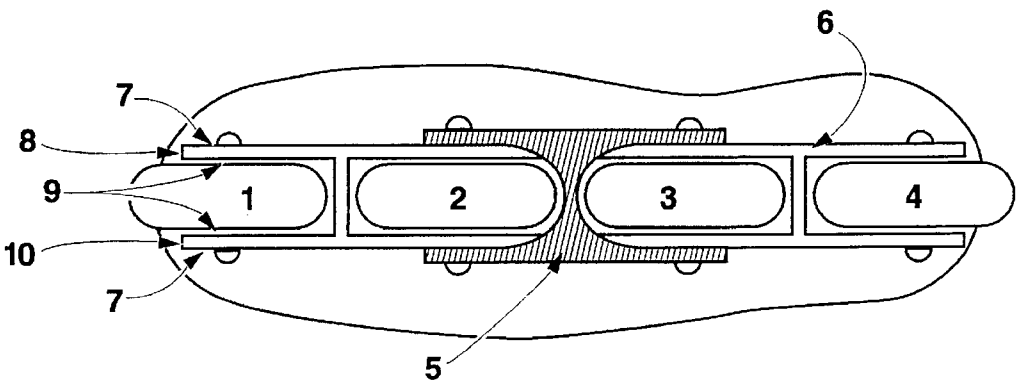
FIG. 1 shows a bottom view of an in-line skate with a protective means according to the invention mounted thereto. Elements 1–4 are wheels. Element 6 is the skate frame, the underside of which is visible in this view. Element 8 represents the inboard side of the frame, while Element 10 is the outboard side of the frame. Element 7 is the exterior surface of the two sides and Element 9 refers to the interior surface of either side. Element 5 (shaded) is the protective means, which as shown is mounted to the exterior surfaces of the inboard and outboard sides of the frame using wheel hardware.
Figure 2:
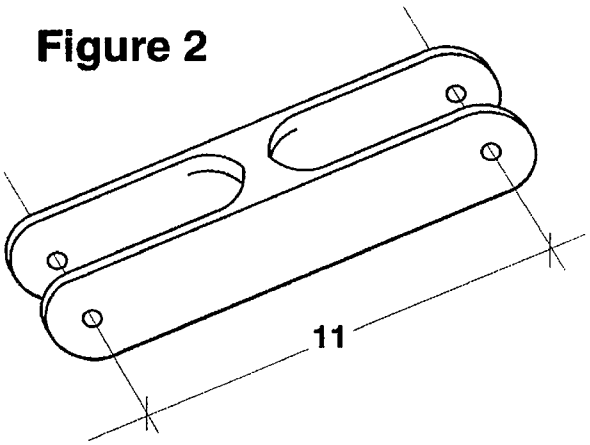
FIG. 2 shows in perspective the protective means mounted in FIG 1. Element 11 represents the distance between the centers of holes used to mount the protective means using wheel hardware.
Figure 3:
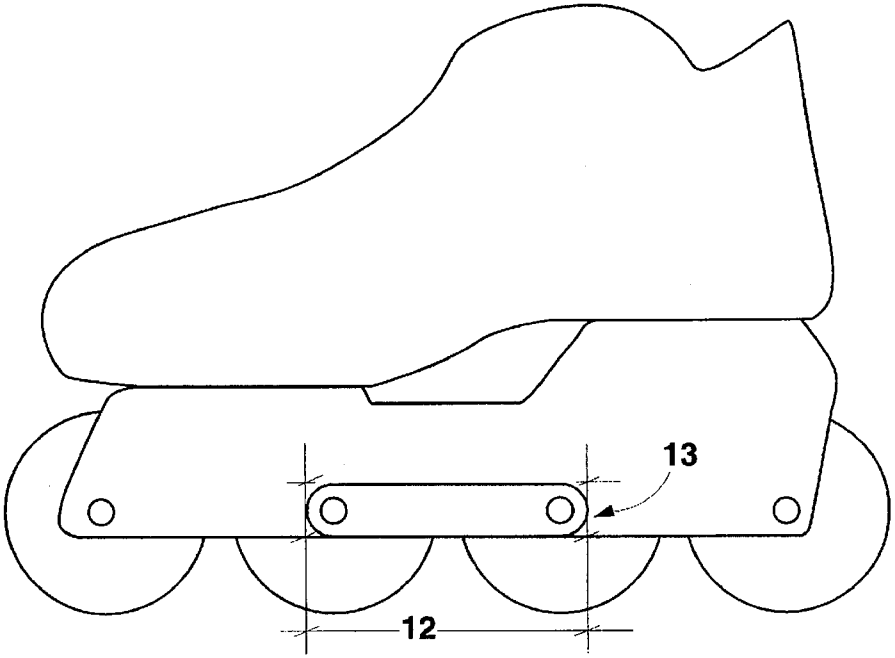
FIG. 3 depicts a side view of but one embodiment of a mounted protective means. Element 12 is the overall length of the protective means and Element 13 is its height.
Figure 4:
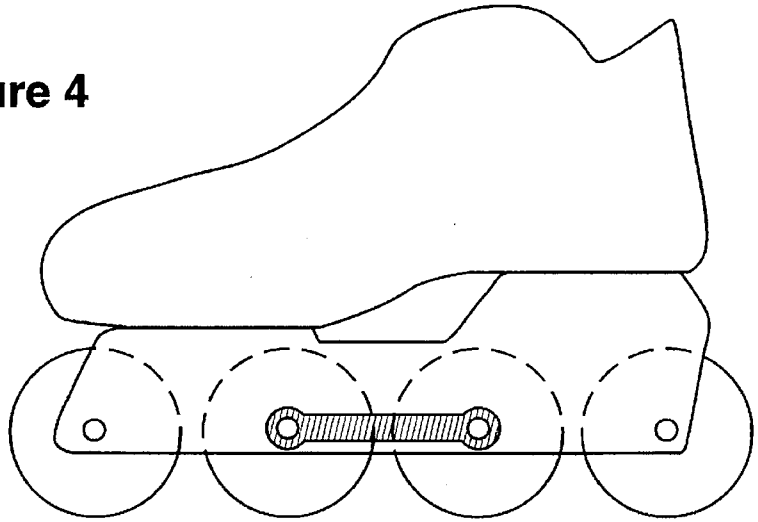
FIG. 4 shows a side view of a 4 wheel in-line skate to which a skate wrench (shaded) is attached using wheel mounting hardware.
Figure 6:
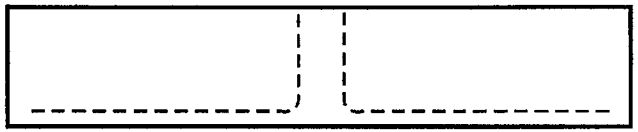
Figure 7:
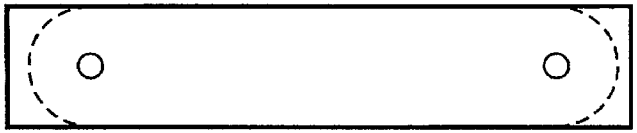
FIG. 7 is a side view thereof.

A skate frame protector according to the invention can be mounted to one or, in a preferred embodiment of the invention, to both sides of a skate frame. As used herein, the side of the skate frame, when attached to an in-line skate, nearest the inside of the boot is referred to as the "inboard" side of the frame (see FIG. 1, element 8), while the "outboard" side is that which is nearest the outside of the boot (FIG. 1, element 10). In addition, a skate frame protector according to the invention may be mounted on either the interior surface (FIG. 1, element 9) or exterior surface (FIG. 1, element 7) of the inboard, outboard, or both sides of the skate frame. In one embodiment of the invention, the skate frame protector is mounted to the exterior surface of either the inboard or outboard side of the skate frame. In another embodiment, a skate frame protector spans from the inboard side to the outboard side of the frame. Such a protector may be mounted to the exterior surface of the two sides, to their interior surfaces, or to the interior surface of one side and the exterior of the other side. Protective means according to the invention may be mounted to a skate frame using wheel mounting hardware, i.e., that hardware used to attach the wheels to the skate frame. Such hardware may be original equipment or may be obtained from one of several after market sources familiar to those in the art. In addition, the skate frame protectors described herein may be mounted using other mounting means independent of, or in combination with, wheel mounting hardware. Other mounting means may include but are not limited to, various types of fasteners, such as bolts, screws, etc., and adhesives, such as epoxies, glues, and other chemical agents capable of bonding a skate frame protector according to her invention to a frame. The use of wheel mounting hardware and/or other fasteners to mount a skate frame protector affords the possibility of later removal, such as to facilitate wheel service or replacement, mounting on another frame, etc. As a result, fasteners, and particularly wheel mounting hardware, are preferred for mounting the protectors described herein, as the use of adhesives typically result in permanent attachment to the frame. However, also envisioned by the present invention is a skate frame protective means comprised of more than one component. The various components of such a protective means may all be permanently affixed, removable, or a combination thereof. For example, permanent protective means may be attached to areas of a frame less susceptible to harmful impacts and/or abrasive contacts than other regions of the frame. As the center regions of a frame (such as the area of the frame between wheels 2 and 3 in a 4 wheel skate, see FIG. 1) typically are exposed to more such impacts and abrasive contacts, in terms of number and severity, it may be preferable that the protective means in this region be easily detachable for purposes of maintenance and/or replacement.

Skate frame protectors according to this invention can be comprised any impact- or abrasion-resistant material. In one embodiment, such materials will be more resistant to damage than the material comprising the skate frame to which the protector(s) is to be been mounted. Lightweight, readily machined materials are preferably utilized. Such materials include metals, hard plastics, composite materials, i.e., fiberglass, carbon fiber, etc., in combination with an appropriate resin, and ceramics. As a variety of skate frame configurations are possible, protectors for such according to this invention will be manufactured, and machined if necessary, to compatibly mount to such configurations. In addition, the inboard and/or outboard sides of a skate frame may themselves be contoured to varying degrees. The present invention contemplates manufacture and/or machining of the disclosed protectors so as to conform, as closely as is necessary to achieve proper attachment, to the contour (s) of a given skate frame.

Figure 15:
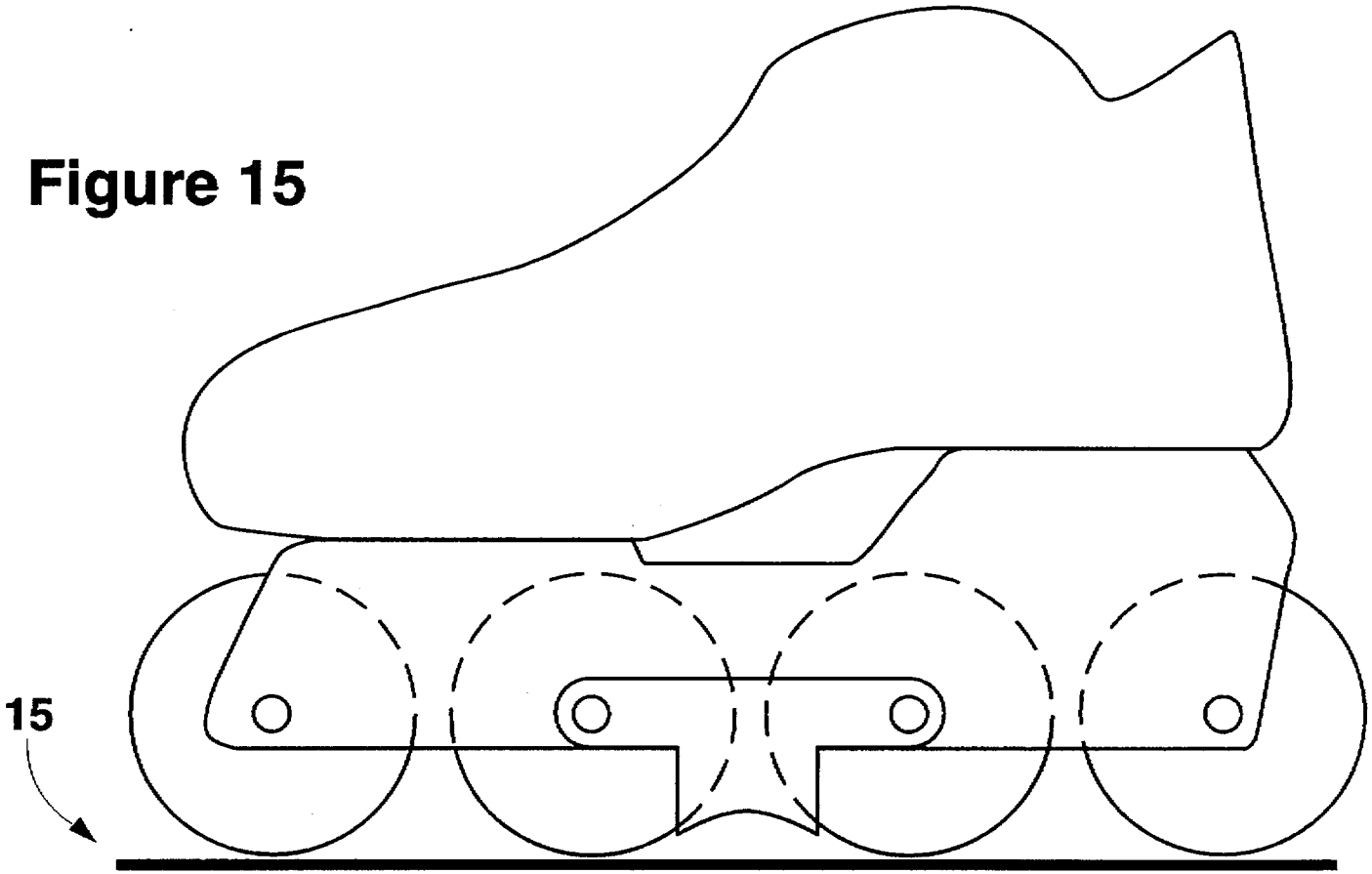
FIG. 15 duplicates FIG. 10, the difference being that the lower portion of the protective means extending beyond the underside of the skate frame is contoured.

As is described in Example 1, one embodiment of a skate frame protective means according to the invention concerns the use of a protective means on both the inboard and outboard sides of the skate frame. Such protective means, when mounted on a skate frame, should at least be flush or even with the lowest surface of the underside of the frame. Preferably, such protectors will protrude beyond the surface of the underside of a frame so as to prevent wear and/or damage to the frame. However, such protrusion should not be so great so as to cause contact with normal skating surfaces under normal skating conditions (which could lead to possible loss of control). In addition, such protrusion should not interfere with a skater's ability to tip or otherwise alter the angle of inclination of the skate. As such interference is affected by factors including the angle of skate inclination and length of the protrusion, protective means according to this invention that extend well beyond the underside of a frame should be designed to account for such factors. One such design is presented in Example 2. In addition, protective means according to the invention, beside protruding beyond the underside of the frame, may also overlap and thus shield the inboard and/or outboard side of the frame. Such overlap or shielding may completely span the underside of the frame. In another embodiment of the invention, a protective means that extends beyond the underside of the frame will be contoured on that surface which is exposed to various contacts. Such contours include, but are not limited to, concave shapes. See FIG. 15.

The following examples are presented to illustrate the practice of the present invention. They are not to be construed as limiting the scope of the invention in any manner.

EXAMPLE 1

Figure 5:
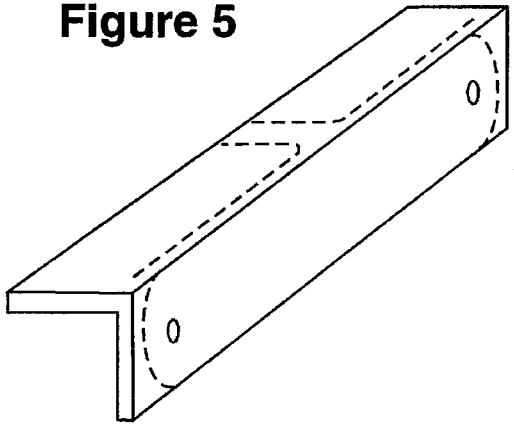
FIG. 5 shows a perspective view of a template (hatched lines) for manufacturing a protective means from a piece of angle iron as described in Example 1.

An in-line skate frame protector according to this invention was manufactured as follows: A template of the skate frame protector as shown in FIG. 5 was sketched onto a 1 ft. length of 0.75 in.×0.75 in. angle iron comprised of 0.125 in. thick material. The desired form was then excised from the angle iron using a jig saw equipped with a blade designed to cut metal. This roughcut piece was then filed along the cut edges for purposes of deburring. Two holes were then drilled through the mounting side of the skate frame protector. The holes were spaced so as to enable the skate frame protector to be mounted to the frame using available wheel mounting hardware. Three other skate frame protectors were manufactured using the same procedure.

Two skate frame protectors were mounted to each of the frames of a pair of 4 wheel in-line skates. On each frame, one skate frame protector was mounted on the inboard side of the frame using the mounting hardware for wheels 2 and 3 (with the front-most wheel being wheel 1 and the rear-most wheel being wheel 4). The other skate frame protector was mounted on the outboard side of the frame opposite the other skate frame protector. The same procedure was used to mount each of the other two skate frame protectors to the other frame of the skate pair.

After fitting the skate frame protectors, the in-line skates were tested under conditions wherein the protectors were subjected to a variety of impacts and contacts with abrasive surfaces. After numerous such tests, the skate frames were examined for damage. None was observed in areas shielded by the skate frame protectors.

Figure 9:
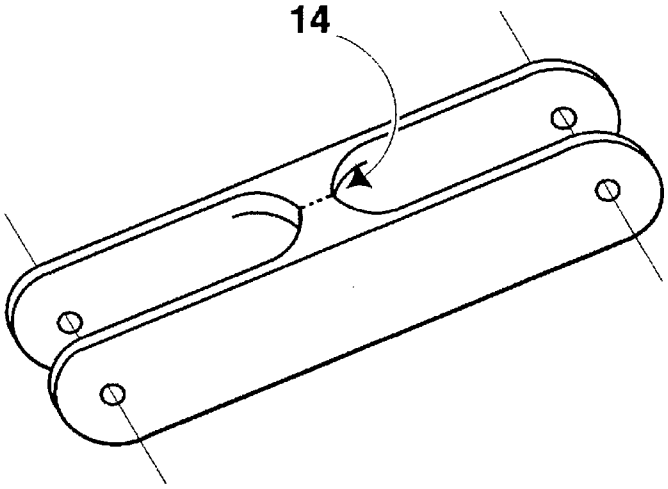
Figure 8:
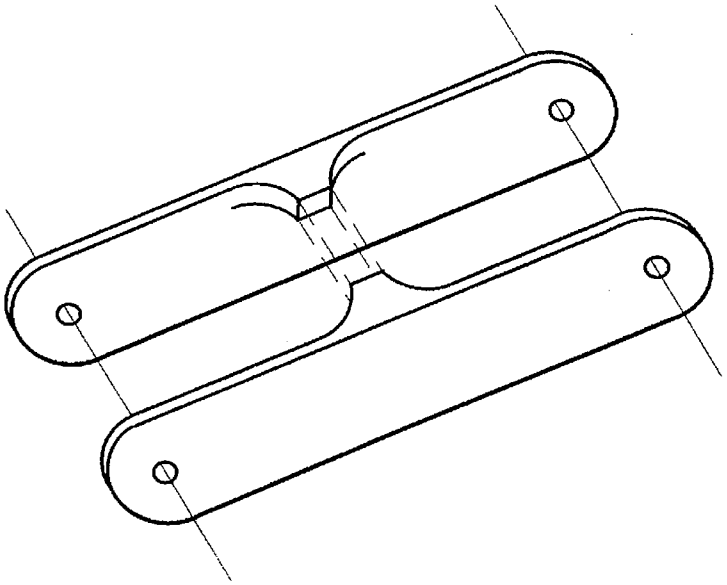
FIG. 8 illustrates two protective means manufactured using the template according to FIG. 5. These two protective means were then welded together as shown in FIG. 9, Element 14.

In an alternative embodiment of the skate frame protectors described above, each of two pairs of skate frame protectors were welded together as shown in FIG. 9 Element 14 prior to being mounted on the frames of a pair of 4 wheel in-line skates. The skate frame protectors were mounted to each frame as before using the mounting hardware for wheels 2 and 3 of each skate. Field testing again revealed the prevention of damaging impacts to and contacts with the shielded portion of each skate frame.

EXAMPLE 2

Figure 10:
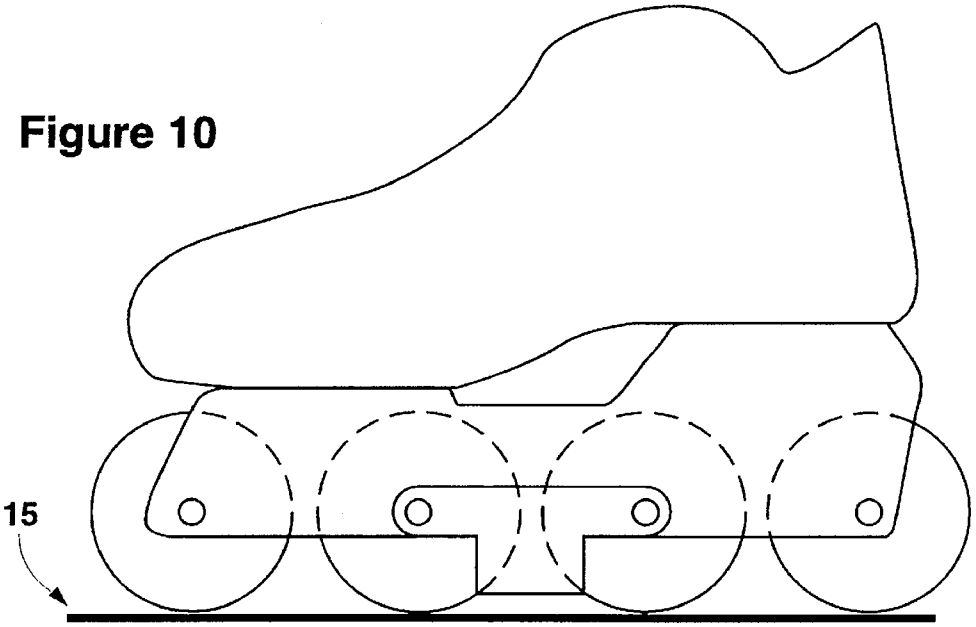
FIG. 10 is a side view of an in-line skate frame to which a protective means has been attached using wheel mounting hardware. The protective means depicted extends beyond the underside of the skate frame but avoids contact with the "ground" (Element 15).
Figure 11:
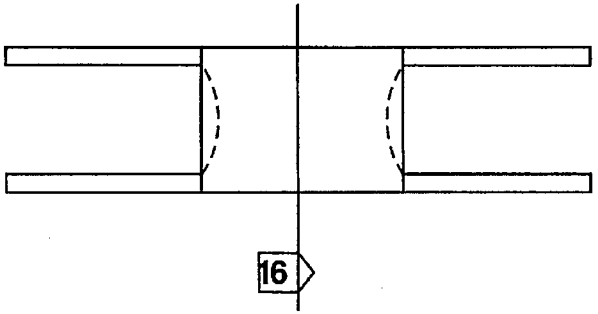
FIG. 11 is a bottom view of the protective means shown in FIG. 10. The hatched lines represent a preferred embodiment wherein the lower portion of the protective means spanning the underside of the frame is machined or manufactured to contour to a wheel shape. The solid line labeled Element 16 represents the region sectioned for FIGS. 12 through 14. 12 through 14 represent cross-sectional views through three possible designs of the lower portion of a protective means as shown in FIG. 10.
Figure 12:
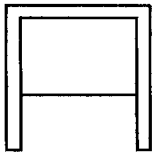
Figure 13:
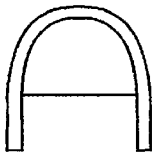
Figure 14:
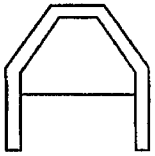

Another skate frame protective means according to the invention comprises a protector with a contact surface only 0.125 in. above the skating surface when mounted. This protective means enables the use of larger wheels as opposed to wheels of smaller size with an in-line skate and is mounted as a single piece to the exterior surfaces of the inboard and outboard sides of a skate frame. As was the case for the protector described in Example 1, this protector is mounted using wheel hardware. As is depicted in FIG. 10, the instant protective means does not interfere with skate inclination. However, in contrast to protective means whose contact surface is at or only slightly protrudes beyond the underside of the frame, this protector provides a larger "sweet spot" (the area of the frame exposed to the largest number of damaging and/or abrasive contacts) and enables a more smooth transition from "grinding" to normal skating than is possible when a protective means as described in Example 1 is used in conjunction with a skate having full size wheels.

While the present invention has been described in terms of its preferred embodiments, it is understood that variations and modifications will occur to those skilled in the art. Therefore, it is intended the appended claims cover all such equivalent variations which come within the scope of the invention as claimed.

What I claim is:

1. An in-line skate frame protector attached to an in-line skate frame, wherein the skate frame carries at least two wheels mounted linearly front to rear between two spaced, parallel sides of the skate frame, the skate frame protector being made of an impact or abrasion resistant material and capable of preventing impact with or abrasion of at least 0.01 inch of a lowermost underside portion of the skate frame, comprising:

(a) a first vertical member attached to one of the spaced, parallel sides of the skate frame;

(b) a second vertical member attached to the other spaced, parallel side of the skate frame and opposite the first vertical member; and (c) a connector spanning from the first vertical member to the second vertical member such that the skate frame protector shields a lowermost underside portion of the skate frame.

2. An in-line skate frame protector according to claim 1 made of metal, plastic, composite material, or ceramic material.

3. An in-line skate frame protector according to claim 1 wherein at least a portion of the connector spanning from the first vertical member to the second vertical member extends a distance X above a skating surface and a distance Y below the underside of the skate frame.

4. An in-line skate frame protector according to claim 1 wherein a lower surface of the skate frame protector is contoured.

5. An in-line skate frame protector according to claim 4 wherein the surface contour is concave.

6. An in-line skate frame protector according to claim 1 attached to a skate frame using wheel mounting hardware.

* * * * *